US010477918B2

(12) United States Patent
Dirsa et al.

(10) Patent No.: US 10,477,918 B2
(45) Date of Patent: Nov. 19, 2019

(54) FOOTWEAR SOLE STRUCTURE WITH ARTICULATING PLATES

(71) Applicant: Under Armour, Inc., Baltimore, MD (US)

(72) Inventors: David Dirsa, Portland, OR (US); Estelle Maranan, Portland, OR (US)

(73) Assignee: UNDER ARMOUR, INC., Baltimore, MD (US)

( * ) Notice: Subject to any disclaimer, the term of this patent is extended or adjusted under 35 U.S.C. 154(b) by 233 days.

(21) Appl. No.: 15/598,630

(22) Filed: May 18, 2017

(65) Prior Publication Data

US 2017/0340054 A1 Nov. 30, 2017

Related U.S. Application Data

(60) Provisional application No. 62/340,637, filed on May 24, 2016.

(51) Int. Cl.

| | |
|---|---|
| ***A43B 13/14*** | (2006.01) |
| ***A43B 13/12*** | (2006.01) |
| ***A43B 13/22*** | (2006.01) |
| ***A43B 1/00*** | (2006.01) |

(52) U.S. Cl.

CPC ..... *A43B 13/141* (2013.01); *A43B 1/0009* (2013.01); *A43B 13/122* (2013.01); *A43B 13/223* (2013.01)

(58) Field of Classification Search

CPC ..... A43B 13/22; A43B 13/12; A43B 13/125; A43B 13/16; A43B 13/141; A43B 13/122; A43B 13/223; A43B 13/226; A43B 13/14

USPC ..... 36/102, 103, 25 R, 30 R, 31

See application file for complete search history.

(56) References Cited

U.S. PATENT DOCUMENTS 5,384,973 A * 1/1995 Lyden ..... A43B 13/12 36/102
5,625,964 A * 5/1997 Lyden ..... A43B 13/20 36/114
5,784,808 A * 7/1998 Hockerson ..... A43B 13/181 36/102

(Continued)

FOREIGN PATENT DOCUMENTS

EP 0377781 A2 7/1990
WO 9105491 A1 5/1991

*Primary Examiner* — Jameson D Collier
*Assistant Examiner* — Heather N Mangine
(74) *Attorney, Agent, or Firm* — Edell, Shapiro & Finnan, LLC

(57) ABSTRACT

An improved sole structure for article of footwear is disclosed herein. The sole structure includes a midsole and an outsole coupled to the midsole. The midsole includes a plurality of grooves disposed both centrally and on the sides of the bottom surface. The outsole includes a plurality of outboard plates, aligned on the sides of the outsole, and a plurality of inboard plates, centrally aligned on the outsole. A plurality of hinges couple the plurality of outboard plates to the plurality of inboard plates such that each of the plates are able to pivot independent of the other plates. The outsole further includes a series of slots and openings aligned with the plurality of grooves of the midsole. The combination of the independent pivotal plates of the outsole, the grooves of the midsole, and flexure of the midsole provide a dynamic and multi-directional flexing sole structure.

20 Claims, 10 Drawing Sheets

(56) References Cited

U.S. PATENT DOCUMENTS 6,009,637 A * 1/2000 Pavone ..... A43B 13/14 36/28
D424,287 S * 5/2000 Edwards ..... D2/951
6,082,023 A * 7/2000 Dalton ..... A43B 13/187 36/103
6,412,196 B1 * 7/2002 Gross ..... A43B 13/026 36/102
6,789,332 B1 * 9/2004 Scholz ..... A43B 7/1425 36/103
7,634,861 B2 * 12/2009 Kilgore ..... A43B 13/141 36/102
7,707,748 B2 * 5/2010 Campbell ..... A43B 5/001 36/102
8,181,365 B2 * 5/2012 Cass ..... A43B 13/181 36/103
8,656,613 B2 2/2014 Stockbridge et al.
2002/0144429 A1 * 10/2002 Hay ..... A43B 7/1425 36/25 R
2005/0262739 A1 * 12/2005 McDonald ..... A43B 3/0057 36/102
2006/0130368 A1 * 6/2006 Morgan ..... A43B 13/145 36/59 R
2008/0229617 A1 * 9/2008 Johnson ..... A43B 3/0057 36/102
2009/0013558 A1 * 1/2009 Hazenberg ..... A43B 1/0009 36/88
2009/0205224 A1 * 8/2009 Rosenbaum ..... A43B 13/141 36/25 R
2010/0115796 A1 5/2010 Pulli
2010/0199523 A1 * 8/2010 Mayden ..... A43B 7/144 36/103
2010/0299965 A1 * 12/2010 Avar ..... A43B 5/06 36/102
2011/0146110 A1 6/2011 Geer
2011/0185590 A1 * 8/2011 Nishiwaki ..... A43B 5/06 36/28
2012/0180336 A1 * 7/2012 Sullivan ..... A43B 7/144 36/31
2013/0031804 A1 2/2013 Abshire
2013/0055596 A1 * 3/2013 Wan ..... A43B 13/141 36/25 R
2013/0152428 A1 * 6/2013 Bishop ..... A43B 13/16 36/103
2013/0174444 A1 * 7/2013 Jacobs ..... A43B 5/12 36/28
2013/0247425 A1 * 9/2013 Davis ..... A43B 13/02 36/30 R
2014/0013624 A1 * 1/2014 Stockbridge ..... A43B 13/00 36/103
2014/0202031 A1 * 7/2014 Seo ..... A43B 13/181 36/28
2014/0215853 A1 * 8/2014 Rushbrook ..... A43B 5/001 36/102
2014/0259744 A1 9/2014 Cooper
2014/0259769 A1 * 9/2014 Bjornson ..... A43B 7/142 36/91
2014/0283413 A1 * 9/2014 Christensen ..... A43B 3/0057 36/102
2014/0290098 A1 * 10/2014 Loverin ..... A43B 13/026 36/103
2014/0360048 A1 * 12/2014 DeHaven ..... A43B 13/141 36/83
2014/0366403 A1 * 12/2014 Reinhardt ..... A43B 13/04 36/30 R
2015/0082669 A1 * 3/2015 Peikert ..... A43B 7/125 36/30 R
2015/0089841 A1 * 4/2015 Smaldone ..... A43B 5/00 36/103
2015/0128452 A1 5/2015 Hull et al.
2015/0135558 A1 * 5/2015 Inomata ..... A43B 13/14 36/25 R
2015/0173456 A1 * 6/2015 Rushbrook ..... A43B 13/141 36/25 R
2015/0257481 A1 * 9/2015 Campos, II ..... A43B 13/20 36/103
2015/0351492 A1 * 12/2015 Dombrow ..... A43B 13/122 36/102
2016/0324254 A1 * 11/2016 McDonald ..... A43B 13/141
2016/0353836 A1 * 12/2016 Luedecke ..... A43B 13/16
2018/0035754 A1 * 2/2018 Inomata ..... A43B 13/14
2018/0064208 A1 * 3/2018 Hurd ..... B29D 35/122

* cited by examiner

FOOTWEAR SOLE STRUCTURE WITH ARTICULATING PLATES

CROSS-REFERENCE TO RELATED APPLICATIONS

This application claims priority under 35 U.S.C. 119(e) to U.S. Provisional Patent Application Ser. No. 62/340,637, entitled "Footwear Sole Structure with Articulating Plates", filed May 24, 2016, the disclosure of which is incorporated herein by reference in its entirety for all purposes.

FIELD OF THE INVENTION

The present invention relates to the sole structure of an article of footwear, and, in particular, a sole structure including having multiple layers that enables modular sole flexion.

BACKGROUND OF THE INVENTION

Conventional footwear contains a sole structure comprising a midsole and an outsole, where the midsole is designed to be flexible and provide support to the foot of a user, while the outsole is configured to be durable, resilient, and wear resistant. Without outsoles, the flexible and compressible midsoles would wear down quickly, reducing the usable lifetime of the sole structure. However, because conventional outsoles are designed to be durable and provide protection to the midsole, outsoles are typically hard and inflexible compared to that of the midsole. The durable and inflexible nature of outsoles prevents the sole structure from providing the proper amount of flexure during a gait cycle. Conventional sole structures are further unable to accommodate for varying impacts with support surfaces, regardless of different user gaits, different foot strikes during gaits, and varying topography of the support surface. Thus, the number of people that find a conventional sole structure fail comfortable and supportive is limited.

Accordingly, it would be desirable to provide a sole structure for an article of footwear that provides a more natural amount of flexure, where the flexure of the sole structure mimics the flexure of a user's foot. It would be further desirable to provide a sole structure where the midsole and the outsole work concurrently with one another to provide multi-directional flexure to provide proper support of a foot regardless of foot strike or support surface topography. It would be further desirable to provide a sole structure where the outsole is capable of flexing with the midsole without reducing the durability and protection provided by outsole.

SUMMARY OF THE INVENTION

The sole structure for an article of footwear includes a midsole and an outsole coupled to the midsole. The midsole includes a top surface and a bottom surface. The bottom surface of the midsole contains a plurality of grooves, positioned both proximate to the sides of the bottom surface and centrally on the bottom surface. The outsole includes a plurality of outboard plates, which are aligned on the sides of the outsole, and a plurality of inboard plates, which are centrally aligned on the outsole. A plurality of hinges couple the plurality of outboard plates to the plurality of inboard plates such that each of the plates are able to independently pivot with respect to the other plates. The outsole further includes a series of slots and openings that align with the plurality of grooves of the midsole. The pivotal plates of the outsole, combined with the slots and openings of the outsole, prevent the outsole from limiting the flexure of the midsole. The resulting sole structure is capable of multi-directional modular flexion, enabling the sole structure to be adaptable to the differing topographies of various support surfaces. The multi-directional flexing sole structure is further configured to more naturally flex during the various phases of a gait cycle.

BRIEF DESCRIPTION OF THE DRAWINGS

Like reference numerals have been used to identify like elements throughout this disclosure.

DETAILED DESCRIPTION OF THE INVENTION

Figure 1:
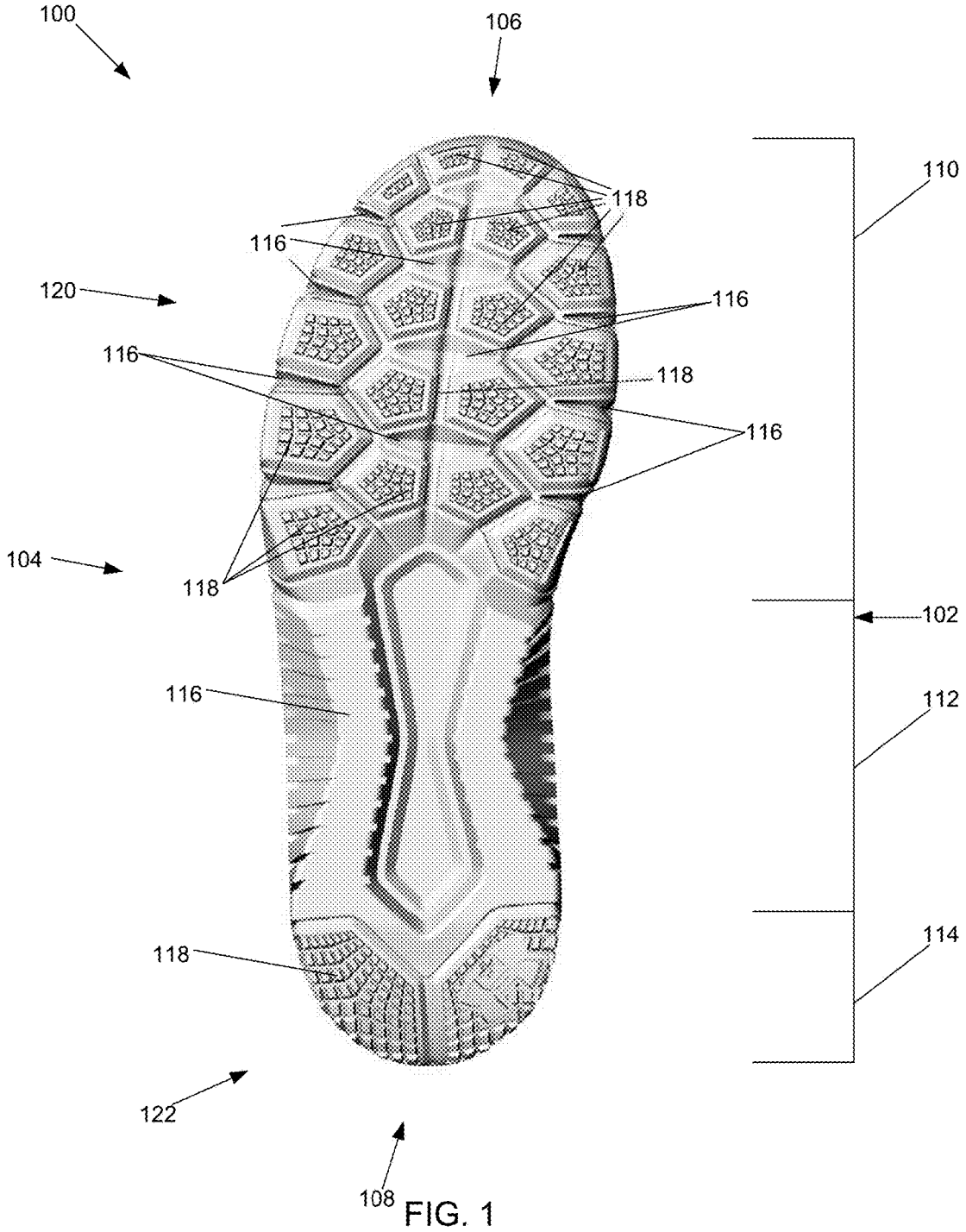
FIG. 1 illustrates a bottom view of an embodiment of the sole structure of an article of footwear according to the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be per-formed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As described herein with reference to the example embodiment of FIGS. 1-3, 4A, 4B, 5-6, 7A, 7B, and 8 a sole structure 100 of an article of footwear (also referred to herein as a shoe), in accordance with the invention, includes a medial side 102 oriented along the medial or big toe side of the user's foot, a lateral side 104 oriented along the lateral or little toe side of the user's foot, a toe (i.e., front) end 106 that corresponds with the toes of the user's foot, and a heel (i.e., rear) end 108 that corresponds with the heel of the user's foot. While the example embodiment depicted in the figures (including FIGS. 1-3, 4A, 4B, 5-6, 7A, 7B, and 8) shows a sole structure 100 configured for a right foot, it is noted that the same or similar features can also be provided for a sole structure 100 configured for a left foot (where such features of the left footed sole structure are a reflection or "mirror image" symmetrical in relation to the right footed sole structure, e.g., the embodiment depicted in FIGS. 1-3, 4A, 4B, 5-6, 7A, 7B, and 8). The sole structure 100 may include a forefoot region 110 that generally aligns with the ball and toes of a user's foot (i.e., when a user is wearing a shoe equipped with the sole structure 100), a midfoot region 112 that generally aligns with the arch and instep areas of the user's foot, and a hindfoot region 114 that generally aligns with the heel and ankle areas of the user's foot. The sole structure 100 illustrated in FIGS. 1-3, 4A, 4B, 5-6, 7A, 7B, and 8 may be utilized for any type of article of footwear, including, but not limited to, shoes, sneakers, boots, sandals, etc.

Figure 2:
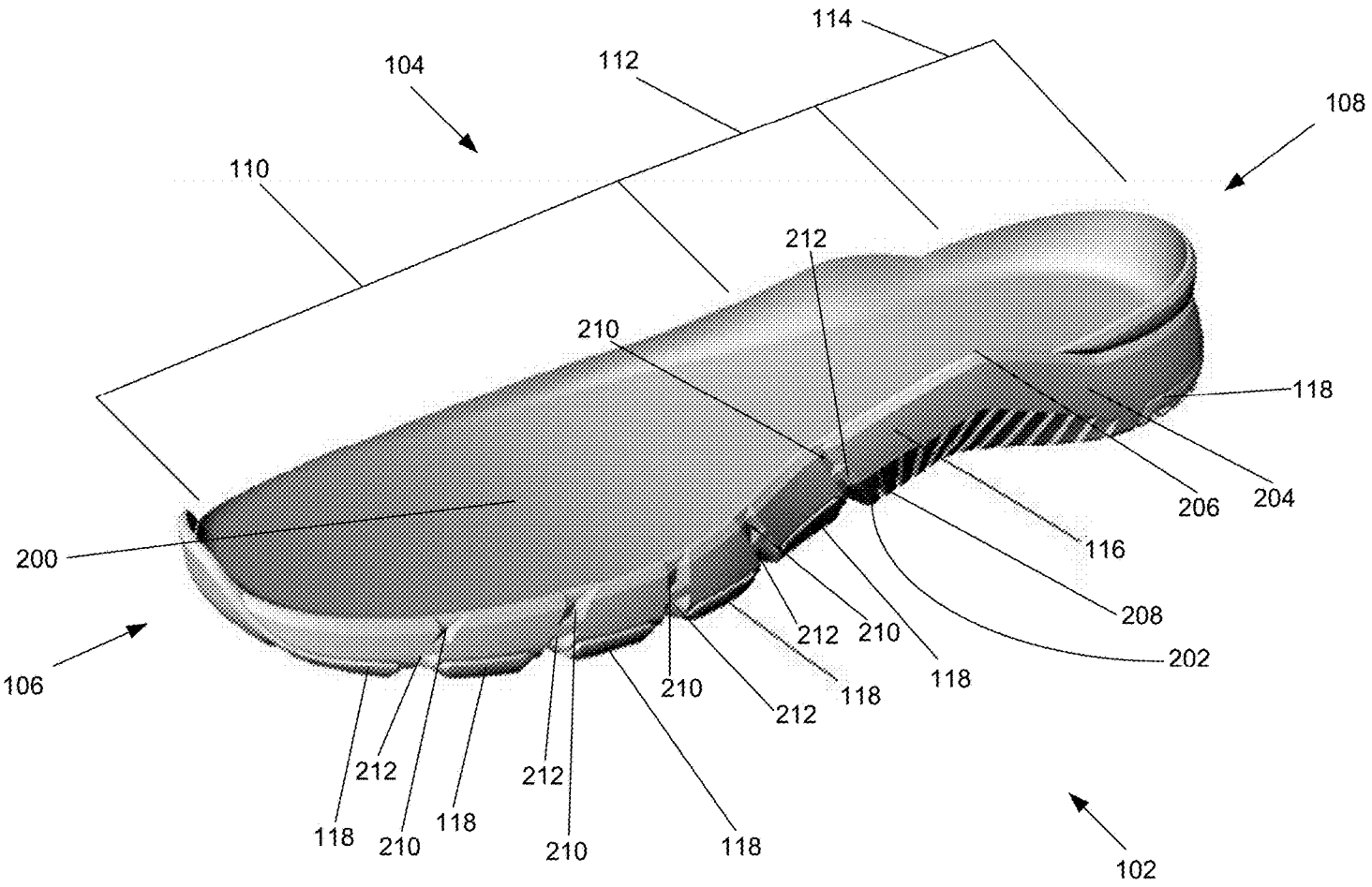
FIG. 2 illustrates a perspective view of the embodiment of the sole structure illustrated in FIG. 1.
Figure 3:
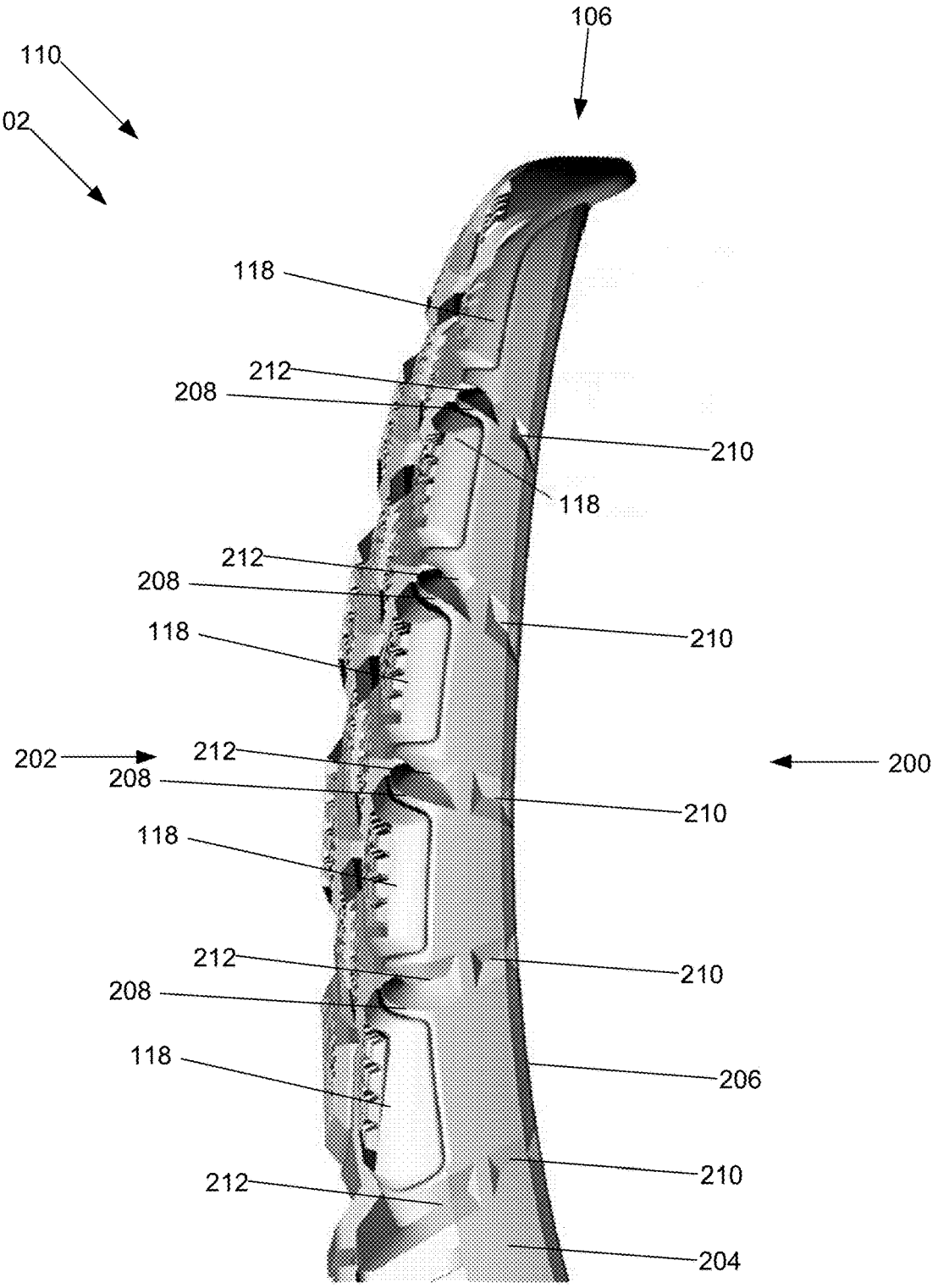
FIG. 3 illustrates a side view of the forefoot region of the embodiment of the sole structure illustrated in FIG. 1.

As best illustrated in FIGS. 1-3, the sole structure 100 includes a midsole structure, or midsole, 116 and an outsole structure, or outsole, 118, where the outsole 118 is coupled to the midsole 116. The midsole 116 may be constructed from a thermoplastic or thermoset material, such as an ethylene-vinyl acetate (EVA) foam material, that is configured to provide cushion and support to a foot as the sole structure 100 impacts a support surface. The midsole may have a durometer value (on a type C scale) of approximately 55 C with a variance of ±3 C. The term "durometer value," as used herein, refers to any standard or other suitable durometer measurement (e.g., a Shore A durometer hardness value, Shore C durometer hardness value, Shore D hardness value, etc.) that provides an indication of hardness, where lower durometer values indicates a softer material and higher durometer values indicates a harder material. In general, harder materials have more wear resistance, but they are also less flexible. Conversely, softer materials possess less wear resistance, but are more flexible. As best illustrated in FIGS. 2 and 3, the midsole 116 includes a top surface 200, a bottom surface 202 opposite the top surface 200, and a sidewall 204 that spans between the top surface 200 and the bottom surface 202. The height of the sidewall 204, or the thickness of the midsole 116 (i.e., the distance between the top surface 200 and the bottom surface 202 of the midsole 116), varies between the forefoot region 110, the midfoot region 112, and the hindfoot region 114. As illustrated, the midsole 116 is thicker in the midfoot and hindfoot regions 112, 114 than in the forefoot region 110. The intersection or attachment between the top surface 200 and the sidewall 204 creates a top edge 206 of the midsole 116. Similarly, the intersection between the bottom surface 202 and the sidewall 204 creates a bottom edge 208 of the midsole 116.

Figure 4A:
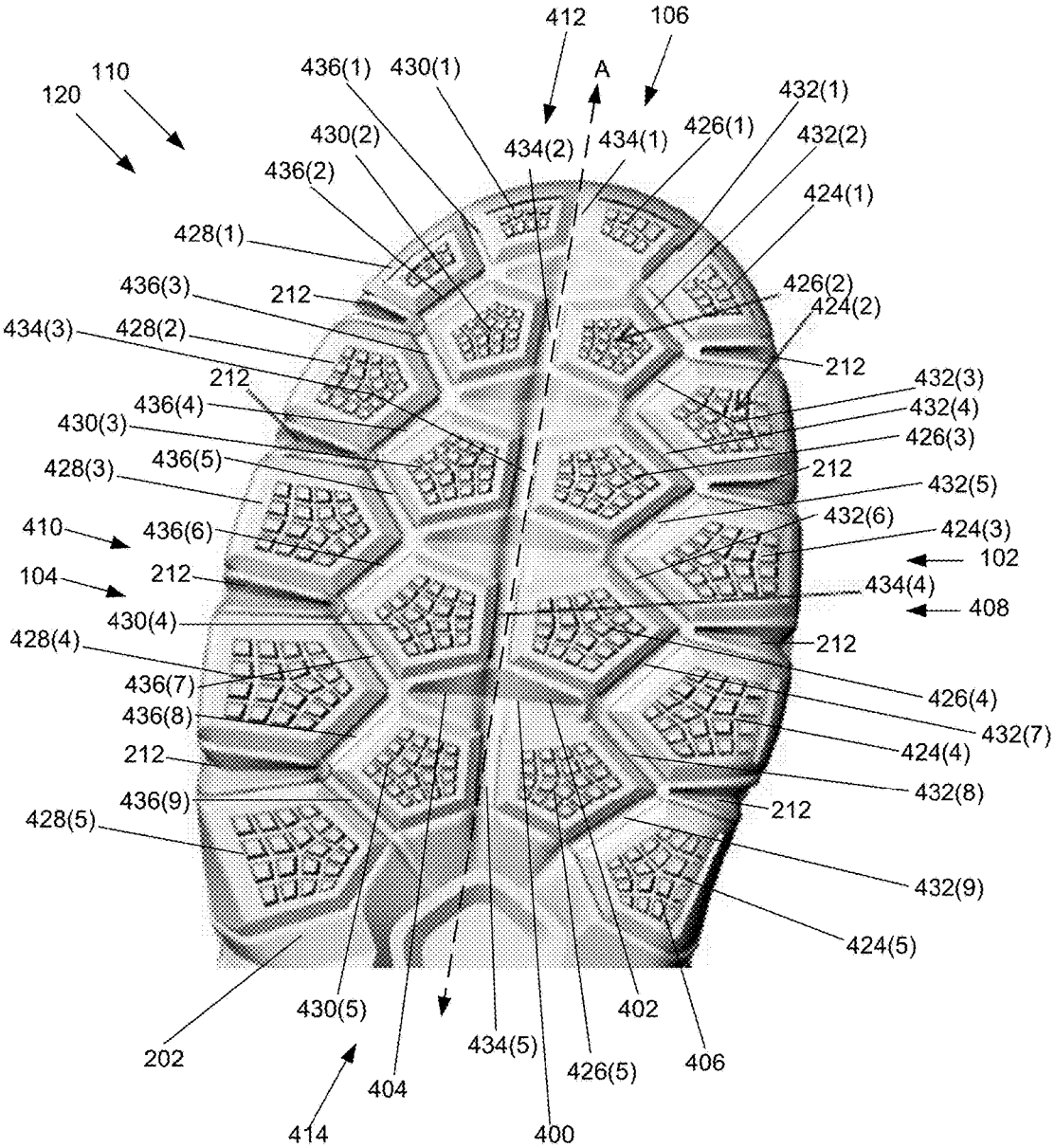
FIG. 4A illustrates a bottom view of the forefoot region of the embodiment of the sole structure illustrated in FIG. 1.

As best illustrated in FIGS. 2 and 3, the midsole 116 includes an upper set of grooves or cutouts 210 disposed within the sidewall 204 proximate to the top edge 206 of the midsole 116. The midsole 116 further includes a lower set of grooves or cutouts 212 disposed within the bottom surface 202 of the midsole 116. In the embodiment illustrated, the lower grooves 212 are configured to extend around the bottom edge 208 of the midsole 116 and be at least partially disposed within the sidewall 204 of midsole 116. Thus, the lower grooves 212 extend at least partially across the bottom surface 202 of the midsole, around the bottom edge 208, and at least partially up the sidewall 204 of the midsole 116, while the upper grooves 210 may be only disposed within the sidewall 204 of the midsole 116. As further illustrated in FIGS. 2 and 3, the upper and lower grooves 210, 212 may be aligned vertically with one another. In the embodiment illustrated, the upper and lower grooves 210, 212 are only disposed in the midsole 116 in the forefoot region 110 of the sole structure 100. In another embodiment, the upper and lower grooves 210, 212 may be disposed in the midsole 116 in all regions (e.g., forefoot, midfoot, hindfoot) 110, 112, 114 of the sole structure 100. Furthermore, for other embodiments of the sole structure 100, the upper and lower grooves 210, 212 may be formed together as continuous grooves that extend from the top edge 206 down the sidewall 204, around the bottom edge 208, and at least partially extend into the bottom surface 202 of the midsole 116. In yet another embodiment, the upper grooves 210 may be configured to extend around the top edge 206 and extend into the top surface 200 of the midsole 116. As illustrated in FIG. 4A, the lower grooves 212 are disposed in the midsole 116 on both the medial side 102 and the lateral side 104. While both sides are not illustrated, the upper grooves 210 may similarly be disposed in the sidewall 204 of the midsole 116 on both the medial side 102 and the lateral side 104.

As best illustrated in FIG. 4A, the midsole 116 further includes a set of central grooves 400. The central grooves 400 may be disposed on the bottom surface 202 of the midsole 116 in a linear alignment along a first directional axis or plane A that is central to the forefoot region 110 of the sole structure 100 (e.g., the grooves 400 are positioned along plane A, which spans along the length (from the toe end 106 towards the heel end 108) of the forefoot region 110 of the sole structure 100). As illustrated, each central groove 400 has a lengthwise dimension that extends in a second direction that traverses plane A of the forefoot region 110 of the midsole 116 (e.g., the central grooves 400 extend substantially along the width, toward both the medial side 102 and the lateral side 104, of the bottom surface 202 of the midsole 116 of the sole structure 100). The central grooves 400 of the embodiment of the midsole 116 illustrated in FIG. 4A are not laterally aligned with the lower grooves 212, and, instead, are spaced between the lower grooves 212. In another embodiment, however, the central grooves 400 may be aligned with the lower grooves 212, and may even be formed with the lower grooves 212 to form continuous grooves that extend from the medial side 102 to the lateral side 104 of the midsole 116.

The grooves 210, 212, 400 are formed as depressions in the bottom surface 202 and the sidewall 204. The grooves 210, 212, 400 may have any cross-sectional shape. In the embodiment illustrated in FIGS. 2 and 3, the grooves 210, 212 may have a triangular cross-sectional shape in the longitudinal direction. The grooves 210, 212, 400 may be formed on the bottom surface 202 and the sidewall 204 of the midsole 116 by any suitable process including, without limitation, etching, engraving, carving, impressing, scoring, incising, stamping, defined during formation of the component (e.g., formed in a molding process), etc.

In addition, as best illustrated in FIG. 4A, both the lower grooves 212 and the central grooves 400 vary in width along their lengths. As the lower grooves 212 extend toward the center, or central plane A, of the bottom surface 202 of the midsole 116, the width of the lower grooves 212 narrow to a point, tip, and/or apex. Thus, the lower grooves 212 may have a minimum width at the point furthest from the bottom edge 208, and a maximum width proximate to the bottom edge 208. Furthermore, each of the central grooves 400 is centrally disposed along the plane A such that each central groove 400 has a first portion 402 and a second portion 404. The first portion 402 of each of the central grooves 400 extends from the central plane A towards the medial side 102 of the midsole 116, while the second portion 404 of each of the central grooves 400 extends from the central plane A towards the lateral side 104 of the midsole 116. In the embodiment illustrated, the first portion 402 and the second portion 404 of each of the central grooves 400 extend equal distances from the central plane A. However, each central groove 400 may differ from one another as to the distance the first and second portions 402, 404 extend from the central plane A. The width and depth of the central grooves 400 may also differ from one another. Each of the central grooves 400, however, are similar in shape. As the first and second portions 402, 404 of each of the central grooves 400 extend from the central plane A, the first and second portions 402, 404 narrow to a point, tip, and/or apex. Thus, the central grooves have a maximum width at the central plane A and a minimum width at the points formed by the first and second portions 402, 404 farthest from the central plane A.

The grooves 210, 212, 400 define primary lines of flexure for portions or segments of the midsole 116, and enable the midsole 116 to have a greater degree of flexure. These primary lines of flexure are aligned substantially perpendicular to the lengthwise direction of the sole structure 100. Because the material used to construct the midsole 116 is flexible, and because of the grooves 210, 212, 400, the midsole 116 is capable of flexing along each of the grooves 210, 212, 400. Thus, the grooves 210, 212, 400 defining the primary lines of flexure along the midsole 116 of the sole structure 100 enable the midsole 116 to flex, bend, and/or conform to the shape of the user's foot as the user wearing an article of footwear equipped with the sole structure 100 performs activities (e.g., walks, runs, jumps, side steps, pivots, etc.). For example, when a user is walking or running while wearing an article of footwear equipped with the sole structure 100, the midsole 116 may be flexed and bent (especially the forefoot region 110) into a curvature when the user is in the toe off phase of a typical walking or running gait.

While the midsole 116 may be constructed from a material that enables the midsole 116 to flex, the grooves 210, 212, 400 may impart even more flexure to the midsole 116 along the primary lines of flexure, which ultimately allows the midsole 116 to have multidirectional flexure. The grooves 210, 212, 400 prevent the overstretching, and possible destruction (e.g., ripping, tearing, etc.), of the midsole 116 when the midsole 116 is flexed or bent inwardly (e.g., the toe end 106 of the sole structure 100 is flexed backwards towards the heel end 108 such that the top surface 200 of the midsole 116 is folded over itself; the medial side 102 of the sole structure 100 is flexed towards the lateral side 104 such that the top surface 200 of the midsole 116 is folded over itself; etc.). The grooves 210, 212, 400 also prevent the midsole 116 from bunching or gathering in various locations along the bottom surface 202 of the midsole 116 when the midsole 116 is flexed or bent outwardly (e.g., the toe end 106 of the sole structure 100 is flexed backwards towards the heel end 108 such that the bottom surface 202 of the midsole 116 is folded over itself; the medial side 102 of the sole structure 100 is flexed towards the lateral side 104 such that the bottom surface 200 of the midsole 116 is folded over itself; etc.).

The outsole 118 may be coupled to the bottom surface 202 of the midsole 116. The outsole 118 may be constructed from a material (e.g., rubber) that is durable and contains a durometer value greater than the midsole 116. The outsole 118 may be constructed from a rubber with a durometer value (on a type A scale) of 60 A and a variance of ±3 A. In other embodiments, the durometer value of the outsole 118 may be greater or lesser than 60 A. As illustrated in FIGS. 1, 2, 4A, 4B, and 5, the outsole 118 consists of a forefoot portion 120 and a hindfoot portion 122. The forefoot portion 120 is disposed on the bottom surface 202 of the midsole 200 in the forefoot region 110 of the sole structure 100. Additionally, the hindfoot portion 122 is disposed on the bottom surface 202 of the midsole 200 in the hindfoot region 114. Thus, the outsole 118 is not disposed on the midsole 116 in the midfoot region 112, leaving the midsole 116 in the midfoot region 112 exposed. In another embodiment, the outsole 118 may be a single continuous structure that extends the length and width of the midsole 116.

Figure 4B:
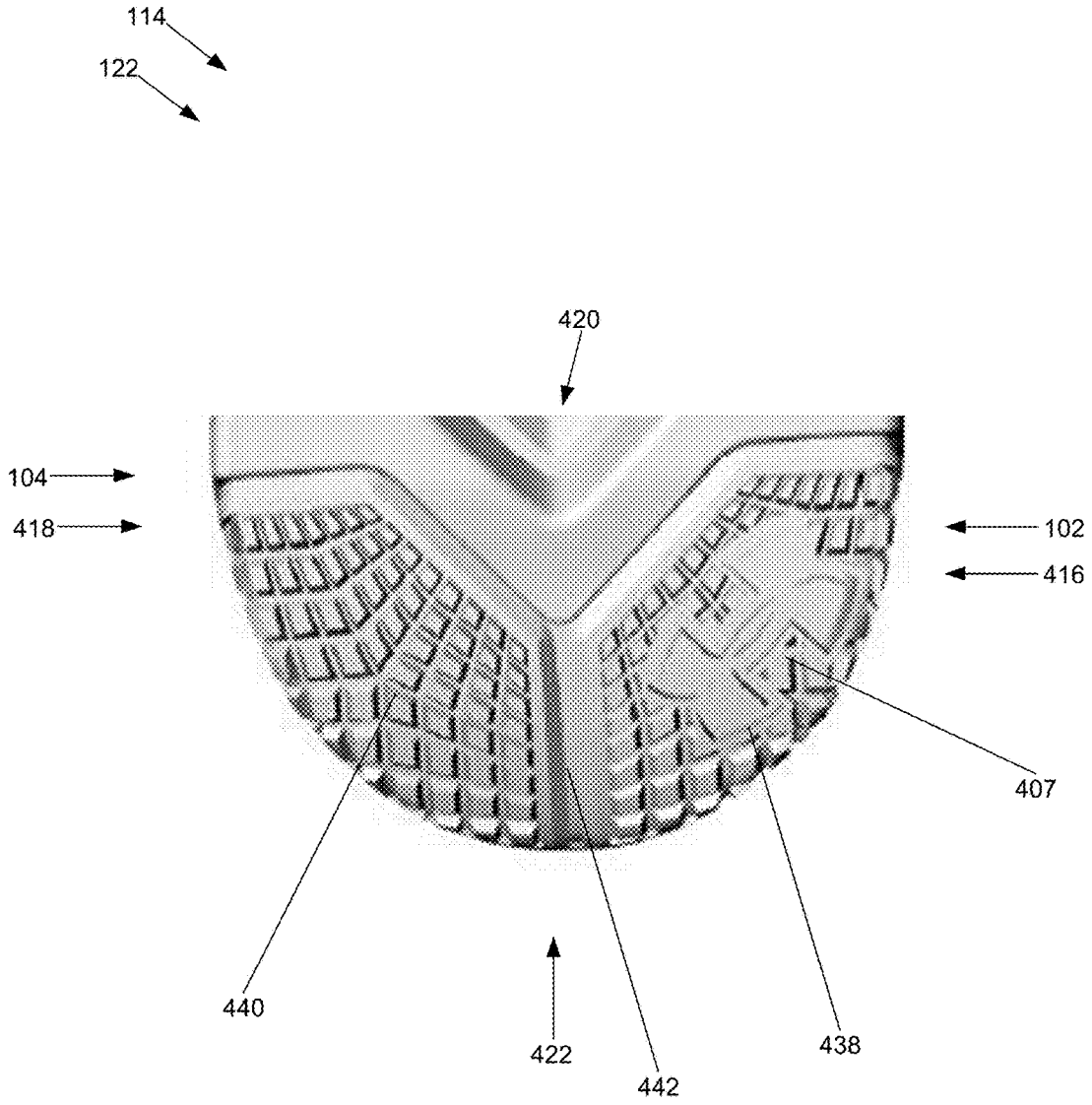
FIG. 4B illustrates a bottom view of the hindfoot or heel region of the embodiment of the sole structure illustrated in FIG. 1.

As illustrated in FIG. 4A, the forefoot portion 120 of the outsole 118 contains a bottom surface 406 configured to contact a support surface and support the forefoot region 110 of the sole structure 100 on the support surface. As illustrated in FIG. 4B, the hindfoot portion 122 of the outsole 118 also contains a bottom surface 407, where the bottom surface 407 is configured to contact a support surface and support the hindfoot region 110 of the sole structure 100 on the support surface. The bottom surfaces 406, 407 together support the entire sole structure 100, and ultimately the article of footwear utilizing the sole structure 100, on a support surface.

Continuing with FIG. 4A, the forefoot portion 120 of the outsole 118 includes a medial side 408 that is oriented proximate to the medial side 102 of the sole structure 100 and a lateral side 410 that is oriented proximate to the lateral side 104 of the sole structure 100. The forefoot portion 120 additionally includes a first end 412 oriented proximate to the toe end 106 of the sole structure 100 and a second end 414 oriented proximate to the midfoot region 112 of the sole structure 100. Similarly, as illustrated in FIG. 4B, the hindfoot portion 122 of the outsole 118 includes a medial side 416, a lateral side 418, a first end 420, and a second end 422. The medial side 416 of the hindfoot portion 122 is oriented proximate to the medial side 102 of the sole structure 100 and the lateral side 418 of the hindfoot portion 122 is oriented proximate to the lateral side 104 of the sole structure 100. The first end 420 of the hindfoot portion 122 is oriented proximate to the midfoot region 112 of the sole structure 100 and the second end 422 is oriented proximate to the heel end 108 of the sole structure 100.

As illustrated in FIG. 4A, the forefoot portion 120 of the outsole 118 includes a series of plates, including medial side outboard plates 424(1)-424(5), medial side inboard plates 426(1)-426(5), lateral side outboard plates 428(1)-428(5), and lateral side inboard plates 430(1)-430(5). As illustrated, the medial outboard plates 424(1)-424(5) are disposed on the medial side 408 of the forefoot portion 120 of the outsole 118, and are hingedly or pivotally coupled to the medial inboard plates 426(1)-426(5) via a series of medial hinges 432(1)-432(9). The medial inboard plates 426(1)-426(5) are disposed proximate to the central plane A, but on the medial side 408 of the central plane A. The lateral inboard plates 430(1)-430(5) are also disposed proximate to the central plane A, but on the lateral side 410 of the central plane A. In addition, the medial inboard plates 426(1)-426(5) are hingedly or pivotally coupled to the lateral inboard plates 430(1)-430(5) via a series of central hinges 434(1)-434(5) that are aligned along the central plane A of the forefoot region 110 of the sole structure 100. As further illustrated, the lateral outboard plates 428(1)-428(5), which are disposed proximate to the lateral side 410 of the sole structure 100, are hingedly or pivotally coupled to the lateral inboard plates 430(1)-430(5) via a series of lateral hinges 436(1)-436(9).

The hinges 432(1)-432(9), 434(1)-434(5), 436(1)-436(9) enable each of the plates 424(1)-424(5), 426(1)-426(5), 428(1)-428(5), 430(1)-430(5) to independently pivot or move with respect to the other plates 424(1)-424(5), 426(1)-426(5), 428(1)-428(5), 430(1)-430(5) based on the outsole's 118 contact with a support surface and the topography of that support surface. For example, medial outboard plate 424(2) is able to pivot about medial hinges 432(3) and 432(4) such that outboard plate 424(2) moves with respect to medial inboard plates 426(2) and 426(3). In another example, medial inboard plate 426(3) is able to pivot about medial hinges 432(4), 432(5) and about central hinge 434(3) such that medial inboard plate 426(3) moves with respect to medial outboard plates 424(2), 424(3) and lateral inboard plate 430(3). Thus, the medial hinges 432(1)-432(9) enable the medial outboard plates 424(1)-424(5) to move independent of the medial inboard plates 426(1)-426(5), and vice versa. The central hinges 434(1)-434(5) enable the medial inboard plates 426(1)-426(5) to pivot independent of the lateral inboard plates 430(1)-430(5), and vice versa. Additionally, the lateral hinges 436(1)-436(9) enable the lateral outboard plates 428(1)-428(5) to move independent of the lateral inboard plates 430(1)-430(5), and vice versa.

The hinges 432(1)-432(9), 434(1)-434(5), 436(1)-436(9) define secondary lines of flexure that are angled with respect to both the lengthwise direction of the sole structure 100 and the widthwise direction of the sole structure 100. Thus, the secondary lines of flexure defined by the hinges 432(1)-432(9), 434(1)-434(5), 436(1)-436(9) are angled with respect to the primary lines of flexure defined by the grooves 210, 212, 400. The non-linear secondary lines of flexure enable torsional flexure of the sole structure 100.

Turning to FIG. 4B, the hindfoot portion 122 of the outsole 118 includes a medial plate 438 disposed on the medial side 416 of the hindfoot portion 122 and a lateral plate 440 disposed on the lateral side 418 of the hindfoot portion 122. As illustrated, the medial plate 438 is hingedly or pivotally coupled to the lateral plate 440 via a central hinge 442. The central hinge 442 enables the medial plate 438 and the lateral plate 440 to independently pivot or move with respect to one another based on the outsole's 118 contact with a support surface and the topography of that support surface. For example, medial plate 438 is able to pivot about central hinge 442 such that medial plate 438 moves with respect to lateral plate 440. In addition, the central hinge 442 defines a line of flexure that extends longitudinally or along the lengthwise direction of the sole structure 100. The line of flexure enables flexure of the sole structure 100 in the hindfoot region 114.

Figure 5:
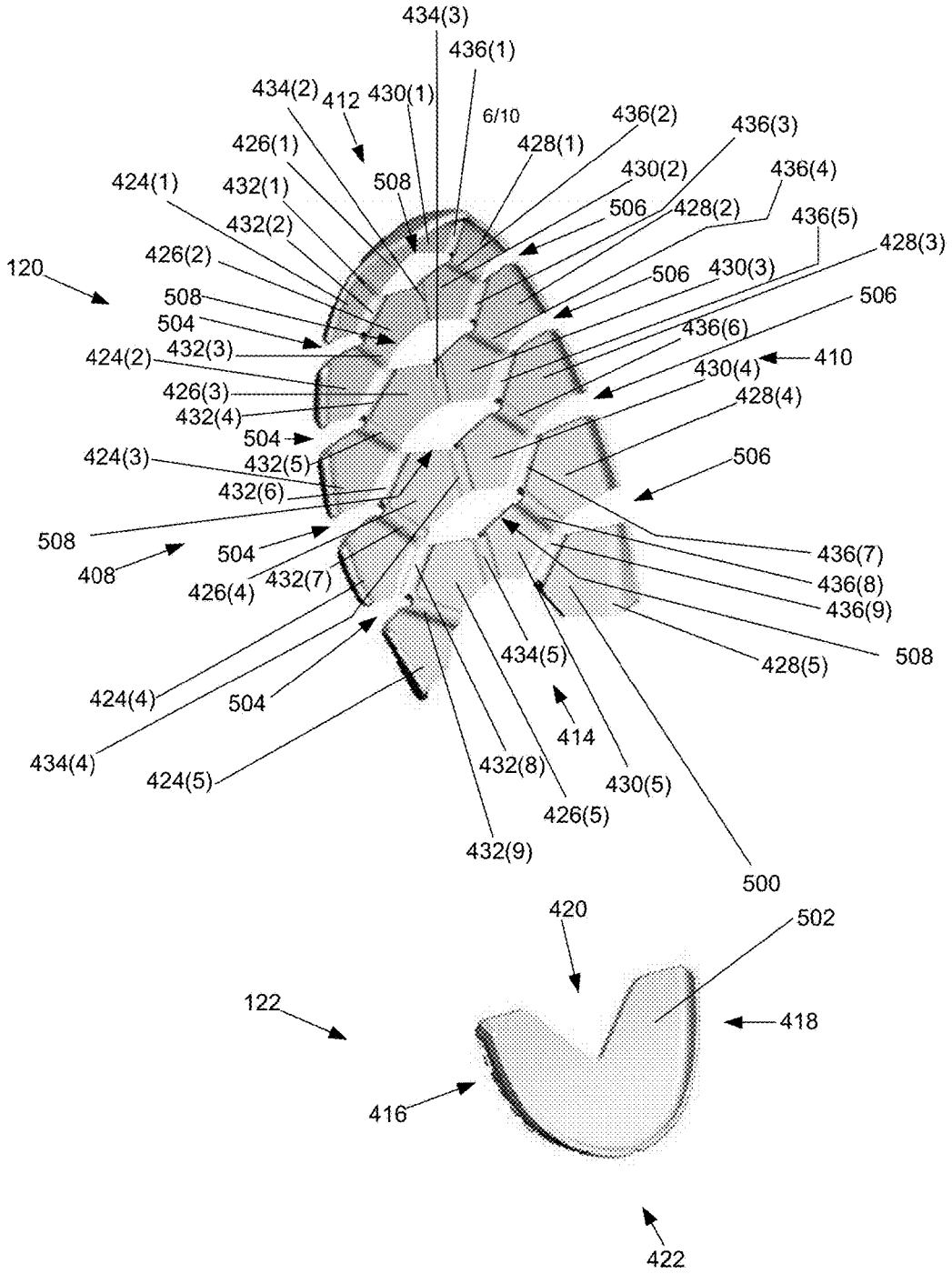
FIG. 5 illustrates a top view of the outsole of the embodiment of the sole structure illustrated in FIG. 1.
Figure 6:
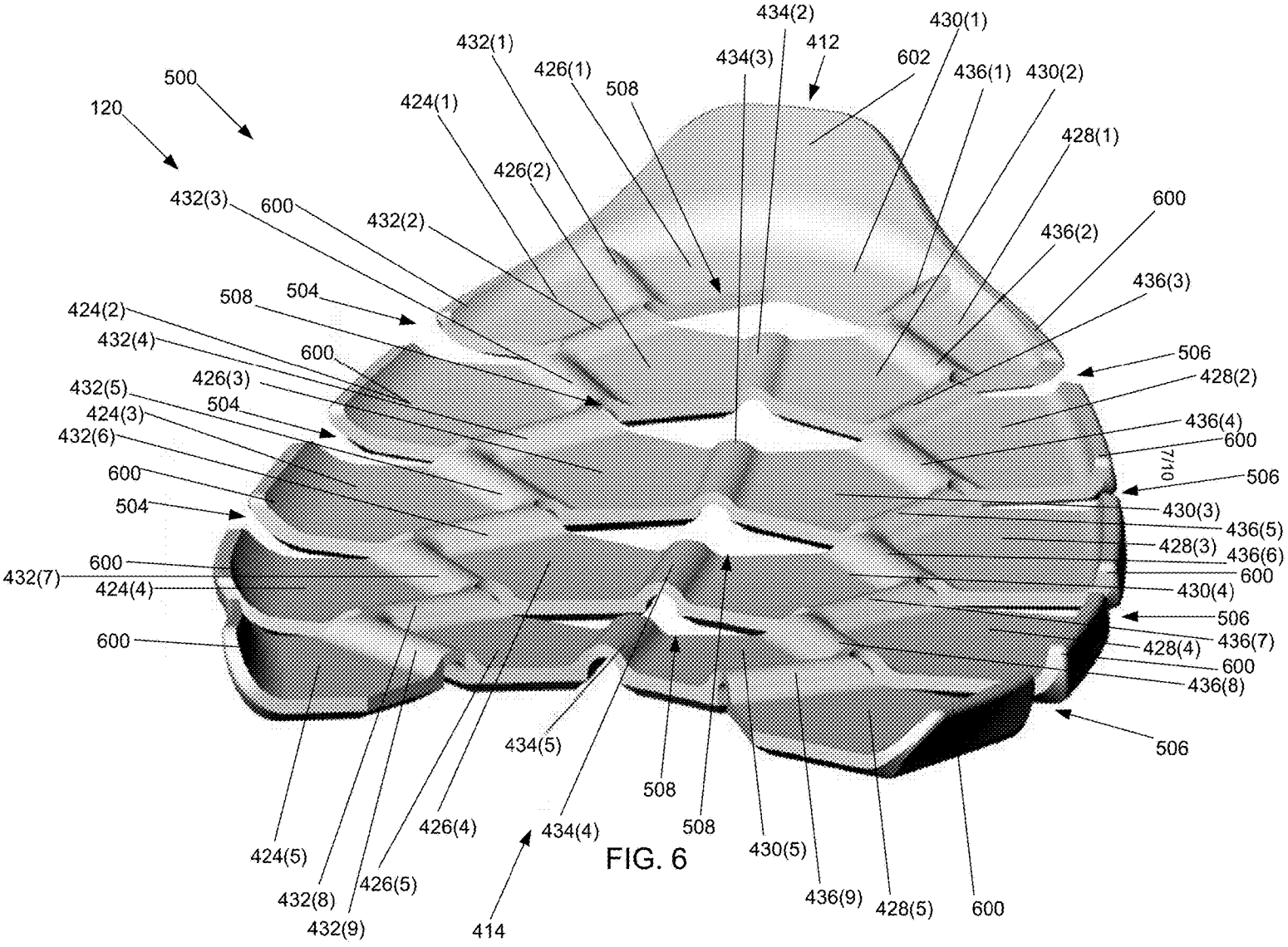
FIG. 6 illustrates a perspective top view of the top of the forefoot region of the embodiment of the sole structure illustrated in FIG. 1.

Turning to FIGS. 5 and 6, the forefoot portion 120 of the outsole 118 includes a top surface 500, while the hindfoot portion 122 of the outsole 118 also includes a top surface 502. The top surface 500 of the forefoot portion 120 of the outsole 118 and the top surface 502 of the hindfoot portion 122 of the outsole 118 are coupled to the bottom surface 202 of the midsole 116. The top surface 500 of the forefoot portion 120 and the top surface 502 of the hindfoot portion 122 may be coupled to the bottom surface 202 of the midsole 116 via bonding, an adhesive, or any other conventional manner. As best illustrated in FIG. 6, the hinges 432(1)-432(9), 434(1)-434(5), 436(1)-436(9) extend upwardly and in a curved manner (e.g., forming rounded or semi-circular shaped hinge structures) from the top surface 500 of the forefoot portion 120 of the outsole 118. While not illustrated, the bottom surface 202 of the midsole 116 may contain a plurality of depressions or cavities in the forefoot region 110 that align with and receive the plurality plates 424(1)-424(5), 426(1)-426(5), 428(1)-428(5), 430(1)-430(5) of the forefoot portion 120 of the outsole 118 when the forefoot portion 120 is coupled to the midsole 116. In addition, the bottom surface 202 of the midsole 116 may also contain a plurality of channels, also not illustrated, that span between the depressions and are aligned with and receive the plurality of hinges 432(1)-432(9), 434(1)-434(5), 436(1)-436(9) of the forefoot portion 120 of the outsole 118 when the forefoot portion 120 is coupled to the midsole 116. The bottom surface 202 of the midsole 116 may contain additional cavities in the hindfoot region 114 that align with and receive the plates 438, 440 and hinge 442 of the hindfoot portion 122 of the outsole 116 when the hindfoot portion 122 of the outsole 116 is coupled to the midsole 116.

In the embodiment illustrated, the plates 424(1)-424(5), 426(1)-426(5), 428(1)-428(5), 430(1)-430(5) of the forefront portion 120 of the outsole 118 are polygonal shaped, in particular pentagonal in shape. However, other embodiments of the forefront portion 120 of the outsole 118 may be of any other shape (triangular, rectangular, hexagonal, heptagonal, octagonal, etc.). As further illustrated, the medial and lateral outboard plates 424(1)-424(5), 428(1)-428(5) are larger in size than the medial and lateral inboard plates 426(1)-426(5), 430(1)-430(5). FIG. 6 further illustrates that the medial and lateral outboard plates 424(1)-424(5), 428(1)-428(5) may contain curved ends 600 that curve upwardly away from the bottom surface 406 and the support surface. As further illustrated in FIG. 7A, the curved ends 600 of the medial and lateral outboard plates 424(1)-424(5), 428(1)-428(5) extend around the bottom edge 208 of the midsole 116 and at least partially up the sidewall 204. The curved ends 600 of the medial outboard plates 424(1)-424(5) are configured to curve around the bottom edge 208 of the midsole 116 proximate to the medial side 102 of the sole structure 100, while the curved ends 600 of the lateral outboard plates 428(1)-428(5) are configured to curve around the bottom edge 208 of the midsole 116 proximate to the lateral side 104 of the sole structure 100. Also illustrated in FIG. 6, the forefoot portion 120 of the outsole 118 includes a toe guard 602 that extends forward and curves upwardly from both medial inboard plate 426(1) and lateral inboard plate 430(1). The toe guard 602 may provide additional durability and protection to the toe end 106 of the sole structure 100 while additionally providing traction during the toe off phase of a user's gait.

FIGS. 5 and 6 further illustrate a plurality of openings, slots, or voids within the forefoot portion 120 of the outsole 118. As illustrated, medial slots 504 are disposed along on the medial side 408 of the forefoot portion 120 between each of the medial outboard plates 424(1)-424(5). The medial slots 504 extend inwardly from the medial side 408 of the forefoot portion 120. Similarly, lateral slots 506 are disposed along the lateral side 410 of the forefoot portion 120 between each of the lateral outboard plates 428(1)-428(5). The lateral slots 506 also extend inwardly from the lateral side 410 of the forefoot portion 120. The forefoot portion 120 of the outsole 118 further includes a set of central openings 508 that are spaced between the pairs of the medial and lateral inboard plates 426(1)-426(5), 430(1)-430(5).

When the forefoot portion 120 of the outsole 118 is coupled to the midsole 116, as illustrate in FIG. 4A, the lower grooves 212 of the midsole 116 are disposed within the medial and lateral slots 504, 506. The lower grooves 212 disposed proximate to the medial side 102 of the sole structure 100 are disposed within the medial slots 504 of the forefoot portion 120. Similarly, the lower grooves 212 disposed proximate to the lateral side 104 of the sole structure 100 are disposed within the lateral slots 506 of the forefoot portion 120. Thus, the lower grooves 212 of the midsole 116 are disposed between each of the medial outboard plates 424(1)-424(5) and each of the lateral outboard plates 428(1)-428(5). In addition, the central grooves 400 are disposed within the central openings 508. It then follows that the central grooves 400 are disposed between each of the pairings of the medial inboard plates 426(1)-426(5) and the lateral inboard plates 430(1)-430(5) via central hinges 434(1)-434(5). Thus, the forefoot portion 120 of the outsole 118 does not cover the lower grooves 212 and the central grooves 400 when coupled to the midsole 116.

Figure 7A:
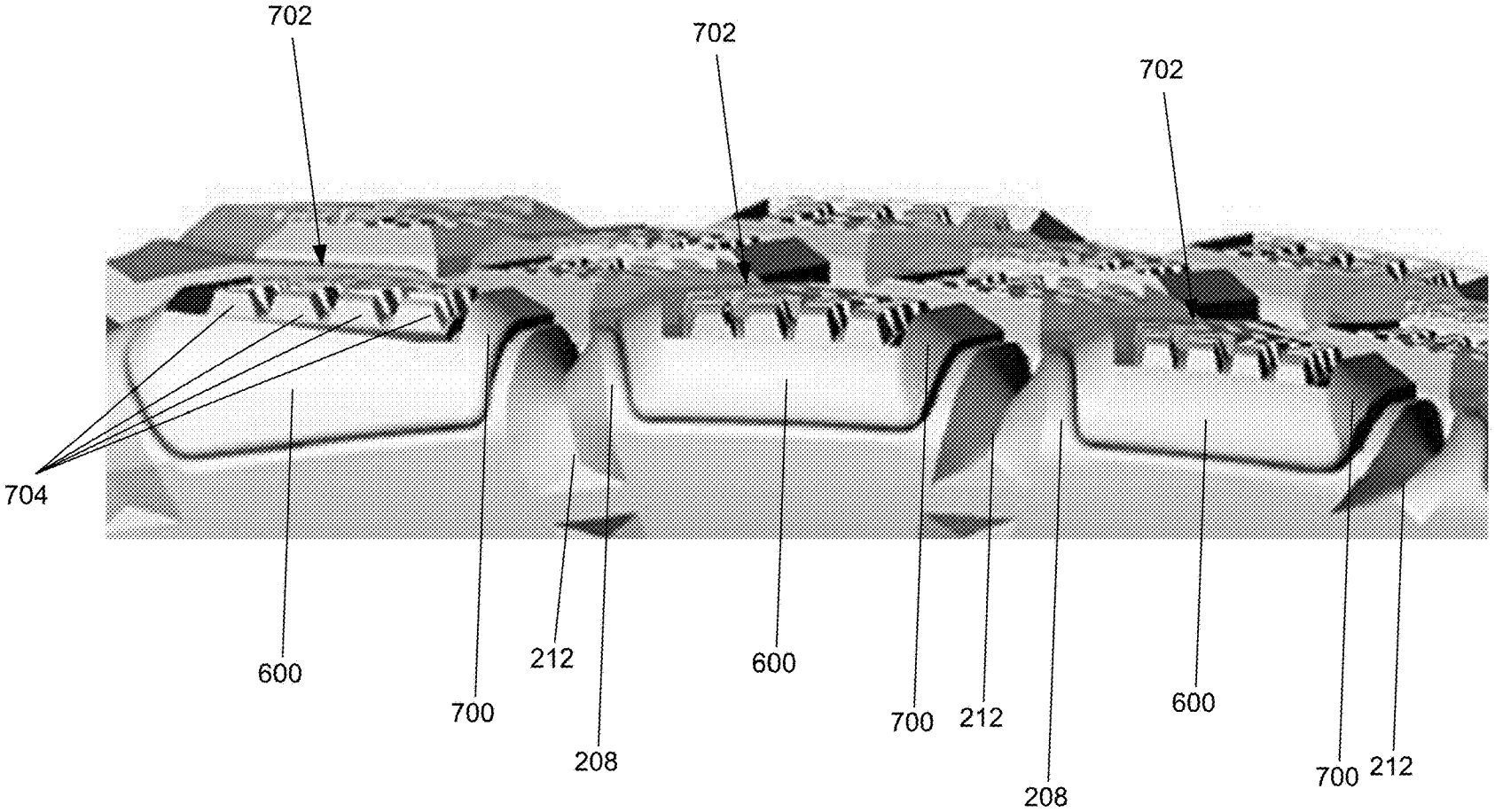
FIG. 7A illustrates a detailed side view of a plurality of plates of the forefoot region of the embodiment of the sole structure illustrated in FIG. 1.
Figure 7B:
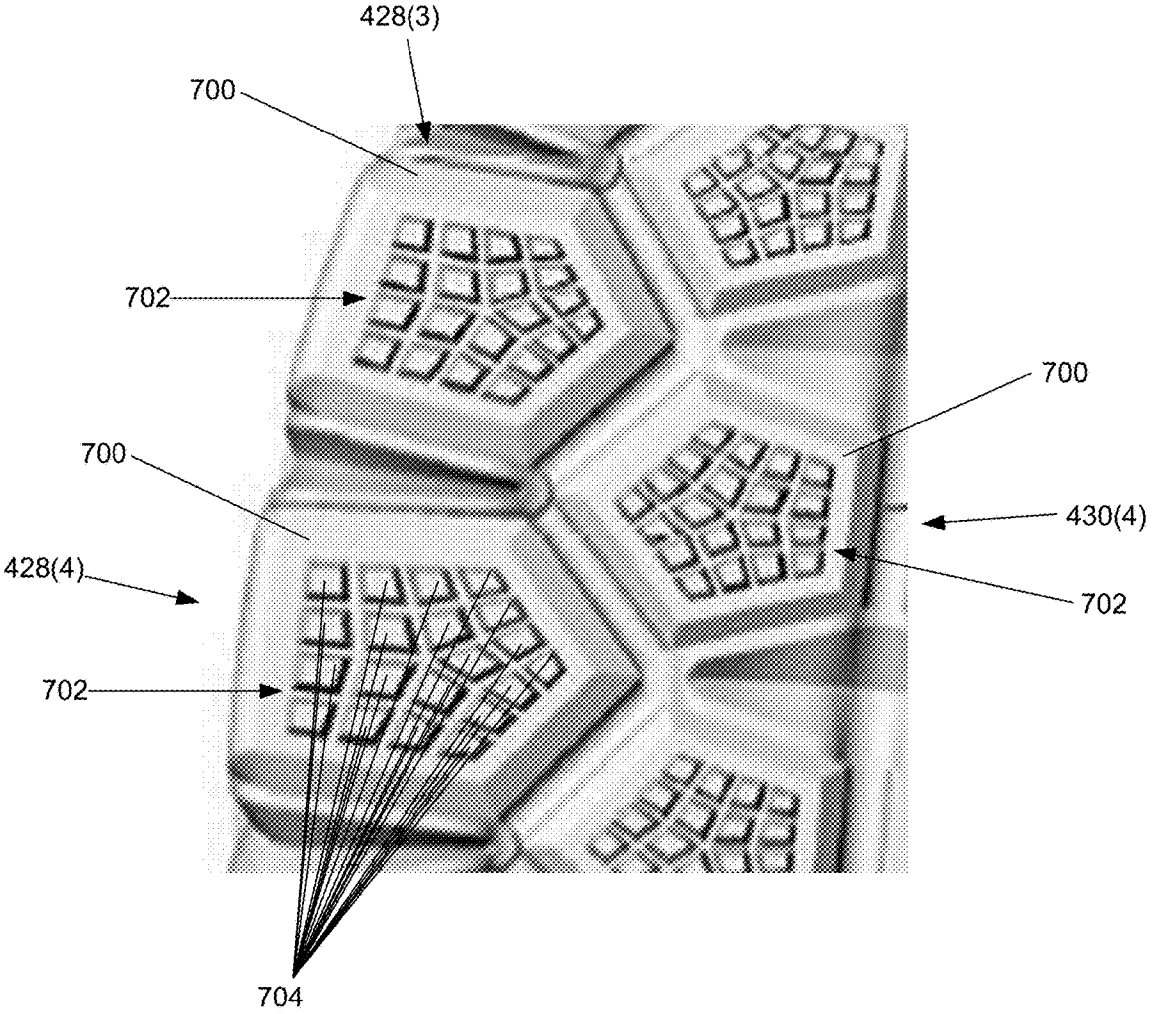
FIG. 7B illustrates a detailed top view of a plurality of plates of the forefoot region of the embodiment of the sole structure illustrated in FIG. 1.

Turning to FIGS. 7A and 7B, each of the plates 424(1)-424(5), 426(1)-426(5), 428(1)-428(5), 430(1)-430(5) may include a border region 700 and a central region 702. Disposed within the central region 702 may be a plurality of lugs, bosses, or protuberances 704 extending outwardly from the bottom surface 406 of the plates 424(1)-424(5), 426(1)-426(5), 428(1)-428(5), 430(1)-430(5) the outsole 118. The plurality of protuberances 704 are configured to contact a support surface to provide increased support and traction to an article of footwear equipped with the sole structure 100.

Figure 8:
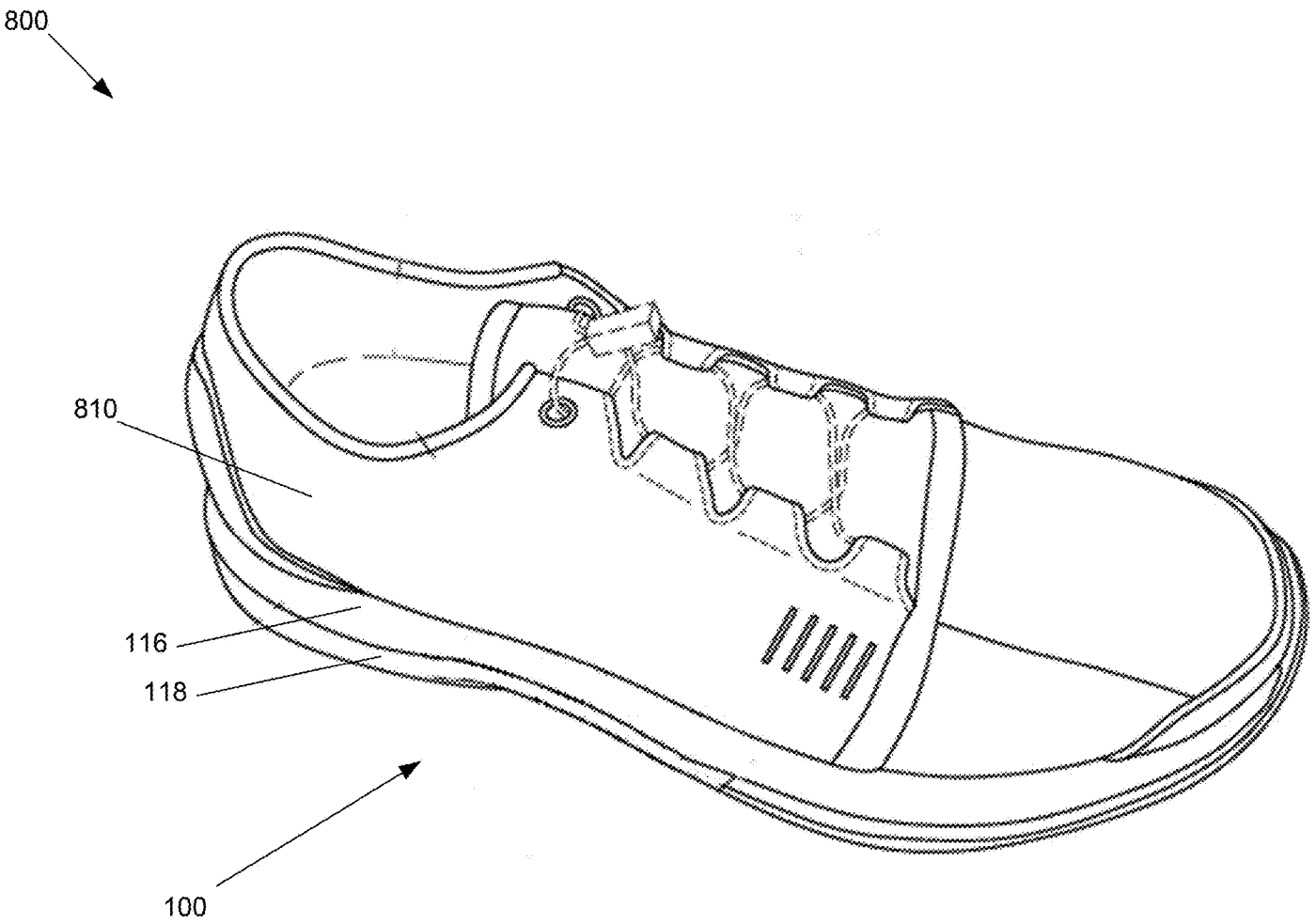
FIG. 8 illustrates a perspective view of an article of footwear containing the embodiment of the sole structure illustrated in FIG. 1.

As illustrated in FIG. 8, an article of footwear 800 may be equipped with the sole structure 100, as described herein. The article of footwear 800 may includes an upper 810 disposed on sole structure 100. More specifically, the upper 810 may be disposed on and coupled to the midsole 116 of the sole structure 100 via any conventional and/or other suitable manner (e.g., via any form of adhesion or bonding, via a woven connection, via one or more types of fasteners, etc.). The upper 810 may be constructed from various materials that are configured to conform and contour to a foot that is placed within the article of footwear 800. In some embodiments, various materials may be used to construct the upper 810, including, but not limited to, leather, synthetic leather, rubber, textile fabrics (e.g., breathable fabrics, mesh fabrics, synthetic fabrics), etc. One material used for the upper 810 may be configured to have a high degree of stretchability and compressibility, while another material used on the upper 810 may have a lower degree of stretchability and compressibility. The materials used on the upper 810 may be generally lightweight and flexible, and may be configured to provide comfort to the user and provide other desirable features. Moreover, the materials used on the upper 810 may be configured to have desirable aesthetics and functional features that incorporate durability, flexibility, air permeability and/or other types of desirable properties to the upper 810. The upper 800 and sole structure 100 cooperate to define a foot cavity adapted to receive a human foot. An opening provides access to the cavity, and enables a foot to enter and be disposed within the cavity As explained previously, the grooves 210, 212, 400 together define primary lines of flexure for portions or segments of the midsole 116 that enable the sole structure to flex and curve along the lengthwise direction. Also explained previously, the hinges 432(1)-432(9), 434(1)-434(5), 436(1)-436(9) define secondary lines of flexure and enable each of the plates 424(1)-424(5), 426(1)-426(5), 428(1)-428(5), 430(1)-430(5) to independently pivot or move with respect to the other plates 424(1)-424(5), 426(1)-426(5), 428(1)-428(5), 430(1)-430(5). Thus, the secondary lines of flexure defined by the hinges 432(1)-432(9), 434(1)-434(5), 436(1)-436(9) enable the plates 424(1)-424(5), 426(1)-426(5), 428(1)-428(5), 430(1)-430(5) of the outsole 118 to torsionally flex and bend in multiple directions with the midsole 116. The independent pivoting and movement of each of the plates 424(1)-424(5), 426(1)-426(5), 428(1)-428(5), 430(1)-430(5) also prevents the outsole 118, when coupled to the midsole 116, from limiting the flexure of the midsole 116. The exposure of the grooves 210, 212, 400 through the outsole 118 further aids in preventing the outsole 118 from limiting the flexure of the midsole 116. The result is a sole structure 100 that provides a more dynamic and anatomical flexure (i.e., more closely mimics the flexure of the foot) during a gait cycle. The independent movement of each of the plates 424(1)-424(5), 426(1)-426(5), 428(1)-428(5), 430(1)-430(5) combine with the grooves 210, 212, 400 to enable the midsole 116 and the outsole 118 to flex concurrently with one another and with greater ease than that of conventional sole structures. In other words, the concurrent flexure of the outsole 118 with the midsole 116 enables the sole structure 100 to provide smoother and more fluid transitions from heel to toe during a gait cycle.

The multi-directional modular flexion, where the midsole 116 and the outsole 118 are configured to flex together not only enables the sole structure 100 to provide a more natural and anatomical flexure during a gait cycle, but also enables the sole structure 100 to provide more stability and support for support surfaces with varied topographies. Most support surfaces are not completely flat, and they sometimes contain objects and debris (e.g., when trail running, hiking, etc.). The multi-directional flexing of the sole structure 100 enables each plate 424(1)-424(5), 426(1)-426(5), 428(1)-428(5), 430(1)-430(5) to pivot a different degree based upon the amount of force experience by each plate 424(1)-424(5), 426(1)-426(5), 428(1)-428(5), 430(1)-430(5) when impacting or contacting a support surface. In addition, when cross-training, for example, uneven and non-level surfaces (e.g., wobble board, BOSU® Ball, balance board, etc.) are used as part of a workout. The multi-directional flexure of the present invention enables the sole structure 100 to adapt to these types of surfaces (e.g., bend and flex outwardly to adapt to a convex surface, torsionally flex, etc.) to provide better stability and traction. Thus, the sole structure 100 is able to adapt to the shape of the support surface, including any debris present between the support surface and the sole structure 100, when in contact with the support surface.

In addition, the multi-directional flexure of the sole structure 100 enables the sole structure 100 to maintain contact with the support surface, regardless of how the bottom of the sole structure 100 strikes or impacts the support surface (based on different user's gaits, foot strikes during gaits, or varying topography of the support surface). The sole structure 100 may impact or strike support surfaces at different angles when performing different movements (e.g., cutting, jumping, running, jogging, etc.). In addition, because users all have different gaits, the sole structure 100 utilized by one user may impact or strike the support surface an angle that differs from that of another user. The independent and torsional movement of the plates 424(1)-424(5), 426(1)-426(5), 428(1)-428(5), 430(1)-430(5) enables the sole structure 100 to quickly adapt to the support surface when striking the support surface at various angles. The result is a sole structure 100 that provides adequate support and flexure to a broad range of user gaits and movements, making the sole structure 100 more universal to users. In other words, the sole structure 100 provides reliable traction through a variety of surfaces and to various users having different gaits.

The present invention embodiments of the sole structure 100 are also more durable and resilient than other multi-flexure sole structures. Other multi-flexure sole structures achieve their flexibility by reducing the amount of outsole that covers the midsole, and by increasing the surface area of the midsole though a series of cuts and incisions. The result is a multi-flexure sole structure with limited durability and short lifespan. Because the outsole 118 of the present invention is constructed from a material (e.g., rubber) that contains a durometer value greater than the midsole 116, the outsole 118 is better suited for contacting support surfaces than the midsole 116. Furthermore, because each of the plates 424(1)-424(5), 426(1)-426(5), 428(1)-428(5), 430(1)-430(5) are connected through a series of hinges 432(1)-432(9), 434(1)-434(5), 436(1)-436(9), the outsole 118 of the sole structure 100 is a network of interconnected individually pivotable plates 424(1)-424(5), 426(1)-426(5), 428(1)-428(5), 430(1)-430(5). This structure of the outsole 118 enables the outsole 118 to cover a significant portion of the bottom surface 202 of the midsole 116 without the outsole 118 limiting the flexure of the midsole 116 or sole structure 100, as previously explained.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A sole structure for an article of footwear, the sole structure comprising:

a midsole having a top surface and a bottom surface; and an outsole coupled to the bottom surface of the midsole, the outsole comprising:

a plurality of outboard plates arranged in a first row disposed on a first side of a central longitudinal axis of the sole structure and a second row disposed on a second side of the central longitudinal axis of the sole structure, a plurality of inboard plates arranged in a third row disposed on the first side of the central longitudinal axis of the sole structure and a fourth row disposed on the second side of the central longitudinal axis of the sole structure, and a plurality of hinges, wherein each inboard plate of the third row of inboard plates is pivotally coupled to a respective inboard plate of the fourth row of inboard plates across the central longitudinal axis via a respective hinge of the plurality of hinges, and wherein each inboard plate of the plurality of inboard plates is directly pivotally coupled to two outboard plates of the plurality of outboard plates via a pair of respective hinges of the plurality of hinges, wherein each outboard plate of the plurality of outboard plates is disposed closer to a medial side of the sole structure and a lateral side of the sole structure in relation to the plurality of inboard plates.

2. The sole structure of claim 1, wherein the outsole further includes a plurality of slots disposed between the outboard plates, and the slots expose portions of the bottom surface of the midsole aligned with the slots.

3. The sole structure of claim 2, wherein the midsole includes a plurality of side grooves that align with the plurality of slots of the outsole so that the plurality of side grooves are exposed through the plurality of slots.

4. The sole structure of claim 2, wherein the outsole further includes a plurality of openings disposed along the central longitudinal axis of the sole structure and disposed between inboard plates, and the openings expose portions of the bottom surface of the midsole aligned with the openings.

5. The sole structure of claim 4, wherein the midsole includes a plurality of central grooves aligned with the plurality of openings of the outsole so that the plurality of central grooves are exposed through the plurality of openings.

6. The sole structure of claim 1, wherein each of the plurality of outboard plates are configured to independently pivot with respect to other plates of the plurality of outboard plates.

7. The sole structure of claim 1, wherein each of plurality of inboard plates are configured to pivot independently with respect to other plates of the plurality of inboard plates.

8. The sole structure of claim 1, wherein each of the plurality of outboard plates are configured to independently pivot with respect to each of the plurality of inboard plates.

9. An article of footwear comprising the sole structure of claim 1 and an upper coupled with the sole structure.

10. A sole structure for an article of footwear, the sole structure comprising:

a midsole having a top surface and a bottom surface; and an outsole having a top surface and a bottom surface, the top surface of the outsole coupled to the bottom surface of the midsole, the outsole further comprising:

a plurality of plates arranged in a first row of plates, a second row of plates, a third row of plates, and a fourth row of plates, the first row of plates and second row of plates being disposed on a first side of a central longitudinal axis of the sole structure, and the third row of plates and fourth row of plates being disposed on a second side of the central longitudinal axis of the sole structure, such that the first row of plates is disposed closer to a medial side of the sole structure than the second, third, and fourth row of plates, and the fourth row of plates is disposed closer to a lateral side of the sole structure than the first, second, and third row of plates, and a plurality of hinges, wherein at least one respective hinge of the plurality of hinges pivotally couples each plate of the plurality of plates to another plate of the plurality of plates such that each plate of the second row of plates is directly pivotally coupled to two plates of the first row of plates via a pair of respective hinges of the plurality of hinges, each plate of the third row of plates is directly pivotally coupled to two plates of the fourth row of plates via a pair of respective hinges of the plurality of hinges, and each plate of the second row of plates is pivotally coupled to a plate of the third row of plates across the central longitudinal axis via a respective hinge of the plurality of hinges, wherein the plurality of hinges enable each plate of the plurality of plates to move independently with respect to other plates of the plurality of plates.

11. The sole structure of claim 10, wherein the plurality of plates are oriented on the midsole such that the plurality of plates and the plurality of hinges define a plurality of openings disposed between the plurality of plates and the plurality of hinges.

12. The sole structure of claim 11, wherein the bottom surface of the midsole includes a plurality of grooves that are aligned with the plurality of openings.

13. The sole structure of claim 12, wherein the plurality of grooves define primary lines of flexure for the sole structure and the plurality of hinges define secondary lines of flexure for the sole structure.

14. The sole structure of claim 10, wherein each plate of the plurality of plates includes a plurality of lugs configured to contact a support surface.

15. A sole structure for an article of footwear, the sole structure comprising:

a midsole;

an outsole coupled to the midsole, the outsole further comprising:

a plurality of outboard plates arranged in a first row disposed on a first side of a central longitudinal axis of the sole structure and a second row disposed on a second side of the central longitudinal axis of the sole structure;

a plurality of inboard plates arranged in a third row disposed on the first side of the central longitudinal axis of the sole structure and a fourth row disposed on the second side of the central longitudinal axis of the sole structure; and a plurality of hinges, wherein each inboard plate of the plurality of inboard plates is directly pivotally coupled to two plates of the plurality of outboard plates via a pair of respective hinges of the plurality of hinges, and wherein each inboard plate of the third row of inboard plates is pivotally coupled to a respective inboard plate of the fourth row of inboard plates across the central longitudinal axis via a respective hinge of the plurality of hinges, wherein the plurality of hinges define lines of flexure that enable each plate of the plurality of outboard plates to flex independent from other plates of the plurality of outboard plates and the plurality of inboard plates and enable each plate of the plurality of inboard plates to flex independent from other plates of the plurality of outboard plates and the plurality of inboard plates.

16. The sole structure of claim 15, wherein each of the plurality of outboard plates include a top surface and a bottom surface, and each of the plurality of inboard plates include a top surface and a bottom surface.

17. The sole structure of claim 16, wherein the top surface of the plurality of outboard plates and the top surface of the plurality of inboard plates are coupled to a bottom surface of the midsole of the sole structure.

18. The sole structure of claim 17, wherein the plurality of hinges extend upwardly from the top surface of the plurality of outboard plates and the top surface of the plurality of inboard plates, and extend into the bottom surface of the midsole.

19. The sole structure of claim 17, wherein the bottom surface of the midsole includes a plurality of depressions that align with and at least partially receive the plurality of outboard plates and plurality of inboard plates.

20. The sole structure of claim 19, wherein the bottom surface of the midsole includes a plurality of channels that align with and at least partially receive the plurality of hinges.

* * * * *